US005382793A

United States Patent [19]

Weinberger et al.

[11] Patent Number: 5,382,793

[45] Date of Patent: Jan. 17, 1995

[54] LASER DESORPTION IONIZATION MASS MONITOR (LDIM)

[75] Inventors: Scot R. Weinberger; Robert W. Egan; Thomas W. Hoppe, all of Reno, Nev.; Ernst Gassmann, Hofstetten; Martin M. Schar, Spiegel, both of Switzerland; Klaus O. Bornsen, Staufen, Germany; E. Rocco Tarantino, Reno, Nev.

[73] Assignee: Hewlett-Packard Company, Palo Alto, Calif.

[21] Appl. No.: 847,450

[22] Filed: Mar. 6, 1992

[51] Int. Cl.[6] ..... H01J 49/00

[52] U.S. Cl. ..... 250/288; 250/281

[58] Field of Search ..... 250/288, 288 A, 281, 250/282, 440.11, 442.11, 287

[56] References Cited

U.S. PATENT DOCUMENTS

| | | | |
|---|---|---|---|
| 4,780,608 | 10/1988 | Cross et al. | 250/281 |
| 4,988,879 | 1/1991 | Zare et al. | 250/288 |
| 5,045,694 | 9/1991 | Beavis et al. | 250/288 |
| 5,083,020 | 1/1992 | Takahashi | 250/288 |

FOREIGN PATENT DOCUMENTS 9000975 4/1991 European Pat. Off. .

OTHER PUBLICATIONS

Franz Hillenkamp, et al., Laser Microprobe Mass Analysis of Organic Materials, Nature, vol. 256, pp. 119–120 (Jul. 10, 1975).

R. Nitsche, et al., Mass Spectrometric Analysis of Laser Induced Microplasmas from Organic Samples, Israel Journal of Chemistry, vol. 17, pp. 181–184 (1978).

M. A. Posthumas, et al., Laser Desorption–Mass Spectrometry of Polar Nonvolatile Bio–Organic Molecules, Analytical Chemistry, vol. 50, No. 7, pp. 985–991 (Jun., 1978).

Franz Heresch, et al., Repetitive Laser Desorption Mass Spectrometry for Nonvolatile Organic Compounds, Analytical Chemistry, vol. 52, No. 12, pp. 1803–1807 (Oct. 1980).

H. J. Heinen, et al., Lamma 1000, a New Laser Microprobe Mass Analyzer for Bulk Samples, Int'l Journal of Mass Spectrometry and Ion Physics, vol. 47, pp. 19–22 (1983).

Robert J. Cotter, Lasers and Mass Spectrometry, Analytical Chemistry, vol. 56, No. 3, pp. 485A–503A (Mar., 1984).

Michael Karas, et al., Influence of the Wavelength in High–Irradiance Ultraviolet Laser Desorption Mass Spectrometry of Organic Molecules, Analytical Chemistry, vol. 57, No. 14, pp. 2935–2939 (Dec., 1985).

B. Spengler, et al., Excimer Laser Desorption Mass Spectometry of Biomolecules at 248 and 193 nm, Journal of Physical Chemistry, vol. 91, No. 26, pp. 6502–6506 (May, 1987).

Michael Karas, et al., Laser Desorption Ionization of Proteins with Molecular Masses Exceeding 10,000 Daltons, Anal. Chem, vol. 60, No. 20, pp. 2299–2301 (Oct. 15, 1988).

Koichi Tanaka, et al., Protein & Polymer Analyses up to m/z 100,000 by Laser Ionization Time–of–Flight Mass Spectometry, Proceeds of the Second Japan–

(List continued on next page.)

*Primary Examiner*—Paul M. Dzierzynski
*Assistant Examiner*—Kiet T. Nguyen
*Attorney, Agent, or Firm*—Heller, Ehrman, White & McAuliffe

[57] ABSTRACT

A laser desorption ionization instrument for measuring the molecular weight of large organic molecules includes a time of flight (TOF) mass spectrometer. The time of flight mass spectrometer includes a sample lock for holding, under vacuum, a plurality of samples to be analyzed. A sample may be inserted into and removed from the sample lock and into the mass spectrometer without breaking vacuum in the spectrometer. Signal processing electronics of the LDIM instrument include means for identifying quasi-molecular species of a molecule being measured. The instrument includes improvements in ion optics, microchannel plate detectors, laser irradiation of samples, and preparation of samples for measurement.

21 Claims, 12 Drawing Sheets

OTHER PUBLICATIONS

China Joint Symposium on Mass Spectrometry, pp. 185–187 (1987).

Ronald Beavis, et al., Matrix-assisted Laser-desorption Mass Spectometry Using 355 nm Radiation, Rapid Communications in Mass Spectrometry, vol. 3, No. 12, pp. 436–439 (1989).

Beavis, et al., Cinnamic Acid Derivatives as Matrices for Ultraviolet Laser Desorption Mass Spectrometry of Proteins, Rapid Communications in Mass Spectrometry, vol. 3, No. 12, pp. 432–435 (1989).

M. Karas, et al., UV Laser Matrix Desorption/Ionization Mass Spectrometry of Proteins in the 100,000 Dalton Range, Int'l Journal of Mass Spectrometry and Ion Processes, vol. 92, pp. 231–242 (1989).

Beavis, et al., Factors Affecting the Ultraviolet Laser Desorption of Proteins, Rapid Communications in Mass Spectrometry, vol. 3, No. 7, pp. 233–237 (1989).

Beavis, et al., Investigations of the Matrix Assisted Laser Desorption of Proteins Using Time-of-Flight Mass Spectrometer, American Society of Mass Spectrometry Meeting Proceedings (1990).

Spengler, et al., Ultraviolet Laser Desorption/Ionization Mass Spectrometry of Proteins Above 100,000 Daltons by Pulsed Ion Extraction Time-of-Flight Analysis, Analytical Chemistry, vol. 62, No. 8, pp. 793–796 (Apr. 15, 1990).

K. O. Bornsen, et al., Analytical Applications of Matrix--assisted Laser Desorption and Ionization Mass Spectrometry, Biological Mass Spectometry, vol. 20, pp. 471–478 (1991).

M. Schar, et al., Fast Protein Sequence Determination with Matrix-Assisted Laser Desorption and Ionization Mass Spectrometry, Rapid Communications in Mass Spectrometry, vol. 5, pp. 319–326 (1991).

LASER DESORPTION IONIZATION MASS MONITOR (LDIM)

BACKGROUND OF THE INVENTION

The present invention relates in general to methods of determining or monitoring the weight of organic molecules. It relates in particular to time of flight (TOF) measurement methods using laser desorption ionization of molecules to be measured.

Time of flight methods of determining molecular weight are normally used for large molecules such as organic molecules (having a molecular weight greater than about 100,000 daltons). Such molecules are generally so heavy that well known deflection mass spectrometric methods are ineffective. In deflection mass spectrometry, ionized species are produced in a vacuum and passed through a magnetic field. The extent to which they are deflected by the magnetic field provides a measure of their weight. Large organic molecules may be sufficiently heavy in relationship to their charge (charge/mass ratio) that they are not readily deflected by a magnetic field.

In time of flight methods of mass spectrometry, charged (ionized) molecules are produced in a vacuum and accelerated by an electric field into a time of flight tube or drift tube. The velocity to which the molecules may be accelerated is proportional to the accelerating potential, proportional to the charge of the molecule, and inversely proportional to the square of the mass of the molecule. The charged molecules travel, i.e. "drift" down the TOF tube to a detector. The time taken for the molecules to travel down the tube may be interpreted as a measure of their molecular weight.

Laser desorption ionization mass monitoring is a TOF mass monitoring method wherein charged molecules of a species to be measured, or analyzed, are produced by laser irradiation (in a vacuum) of a crystalline host matrix including a small proportion, for example between about 1:1000 and 1:10,000 of the species. Irradiation with ultraviolet (UV) radiation is generally preferred. The host matrix is selected to optimally absorb and transfer the energy radiation to the analyte. The absorbed energy is transferred to the analyte which is ejected or desorbed from the matrix in the form of charged molecules (ions). The desorbed, charged molecules are then accelerated into a drift tube. The time of flight of the molecules through the tube is generally determined by detecting the irradiating pulse and using the detected signal to start a timing process. Charged molecules generated by the irradiating pulse are intercepted by a detector after they have traversed the drift tube. A signal from the detector caused by the intercepted molecules is used to stop the timing mechanism thus establishing the time of flight. Molecular weight of a given analyte may be determined by relating the flight time required for molecules of the desorbed analyte to travel to the detector, to a linear function describing mass/charge ratio and flight time. The mass/charge ratio:flight time relationship is determined by calibrating the function using a standard of predetermined molecular weight.

Two classifications of LDIM instruments have been established, microprobe instruments and bulk analysis instruments.

In a microprobe instrument, laser irradiation is finely focused to a small spot on a foil containing the analyte. The laser radiation is in the form of a short pulse of very high power density. The power density is such that a small hole is produced in the foil. Analyte ions are desorbed from the foil and emerge from the hole. A commercially available LDIM microprobe instrument is described in Heinen, F., et al., Int. J. Mass Spec. Ion Physics, vol. 47, 1983, 19–22.

Bulk analysis instruments use moderately focussed beams, for example, beams focussed to a spot having an area greater than about 0.1 millimeters. The beams are incident on a surface including the analyte in a host matrix. The matrix and analyte are applied in the form of a thin crystallized layer or layers on a surface forming the tip of a sample probe. In the bulk analysis instrument, an area on the probe tip may be irradiated sequentially, with multiple laser pulses. This may be helpful, for example, in gathering statistical data on measurements.

In prior art ionization methods used in mass spectrometry, energetic or "hard" ionization processes, for example, using energy exchange within a gas discharge, may produce fragmentation of analyte molecules, i.e. the formation of metastable ions having a range of different weights.

In both microprobe and bulk LDIM methods the laser desorption ionization method produces what may be termed "soft ionization" of an analyte. Soft ionization provides that predominantly single charged unfragmented analyte ions are generated. Preferably, ions are desorbed by a laser pulse having an intensity just above that threshold intensity required to cause desorption. In a pulsed laser it is difficult to provide pulses of repeatable intensity particularly if a laser is operated intermittently. Further, thresholds may vary between matrix sample combinations. If a pulse has an intensity significantly greater than the desorption threshold, abducts may be formed by the addition of one or more matrix molecules to a sample. This causes a distribution of indicated molecular weights around a true value leading to measurement uncertainty or loss of mass resolution.

In LDIM, mass resolution is determined in terms of mass/difference in mass ($m/\Delta m$). This is a measurement of an instrument's ability to produce separate signals from ions (molecules) of similar mass. LDIM mass resolution is dependent upon the molecular weight of an analyte. Generally, mass resolution decreases as analyte molecular weight increases. A mechanism for this phenomenon is believed to be covalent abduct formation between analyte and matrix material.

Generally, molecular weight measurement accuracy reflects the uncertainty in assigning a molecular weight value to a given measurement of flight time. In addition, however, to uncertainties due to molecular weight of the analyte, a significant factor in limiting mass resolution is the uncertainty of the flight time measurement. Here, the primary limiting factor is that desorbed ions are released over a finite time interval which has some limit of reproducibility from one laser (desorbing pulse) to another. For example, if a molecular weight corresponds to a flight time of about twenty-six microseconds (26 $\mu$sec), and if the desorbed analyte molecules are released over a period of about two-hundred nanoseconds (200 nsec) in a first pulse and 220 nsec in a subsequent pulse, then the maximum resolution from this uncertainty alone would be about one part in one thousand. The release time may be affected by the pulse width and spatial energy distribution, and repeatability of the laser radiation pulse causing the desorption. The release time may also be affected by the type and preparation of the sample on a probe tip. The flight time itself may be affected by vacuum conditions, for example by collisions between drifting species and residual gases in the vacuum enclosure.

A preferred detector for LDIM instruments is a microchannel plate (MCP) detector which accelerates an incident ion pulse through one or two plates comprising a matrix of microscopic tubes. As ions pass through the tubes, they generate ions by collision with tube walls. An MCP detector operates best when ions strike a multichannel plate at high velocity. Preferably, an accelerating potential of about minus five thousand volts should be applied to accelerate the ions. A microchannel plate, however, operates optimally when a potential not greater than one thousand volts is applied across it and is not limited by electron depletion.

Another source of uncertainty in LDIM measurements is the formation of ions of the same molecule having different charges or from the formation of clusters of two or more molecules each having one or more unit charges per molecules. These may be referred to as quasi molecular ions and will have different flight times in an LDIM instrument. As such, they may indicate that different molecules are present in a sample and thus lead to difficulty in assessing the purity of a sample.

Still another source of uncertainty in LDIM measurements may lie in the preparation of samples. It is important to lay down an even, reproducible layer of matrix and analyte on a sample probe tip. Usually a droplet of matrix/analyte solution is applied to a probe tip. The drop is then crystallized by applying a vacuum to the probe tip to remove volatile fluid components. If the droplet is irregular in shape then thickness and sample distribution in the crystallized layer can be nonhomogeneous leading to unreproducible measurement results. If vacuum application is not variable, highly lipophilic analyte/matrix mixtures will be difficult to crystalize since more volatile components of the mixture will cause less volatile components to bubble.

U.S. Pat. No. 5,045,694 discloses an electrospray method of applying matrix to a probe tip. Although this method appears to produce better matrix layers, it involves applying a potential of about five thousand volts to the probe tip during application of the layers. This makes the method somewhat hazardous and can lead to corona discharge between the probe tip and the spray apparatus which may damage the probe tip and spray apparatus.

In view of the foregoing it will be evident that although LDIM provides a potentially convenient method for monitoring molecular weight of large organic molecules, there is a need for improvement in many hardware aspects of the technology including sample preparation, delivery of laser pulses, ion optics, and detectors. There is also a need for improved signal processing technology to identify and eliminate uncertainties which may arise, particularly from the generation of quasi molecular ions.

SUMMARY OF THE INVENTION

It is an object of the present invention to provide improvements in resolution, reproducibility, and accuracy in LDIM monitoring of organic molecules. This has been accomplished by providing improvements in several facets of LDIM analysis and instruments including: sample preparation methods; methods of introducing samples into an LDIM instruments; methods of laser irradiating samples in an LDIM instrument; ion optics; laser optics, including reproducibility of the incident laser irradiation; microchannel plate detectors; and interpretation of measurement results.

BRIEF DESCRIPTION OF THE DRAWINGS

The accompanying drawings, which are incorporated in and constitute a part of the specification, schematically illustrate a preferred embodiment of the invention and, together with the general description given above and the detailed description of the preferred embodiment given below, serve to explain the principles of the invention.

DETAILED DESCRIPTION OF THE INVENTION

Figure 1:
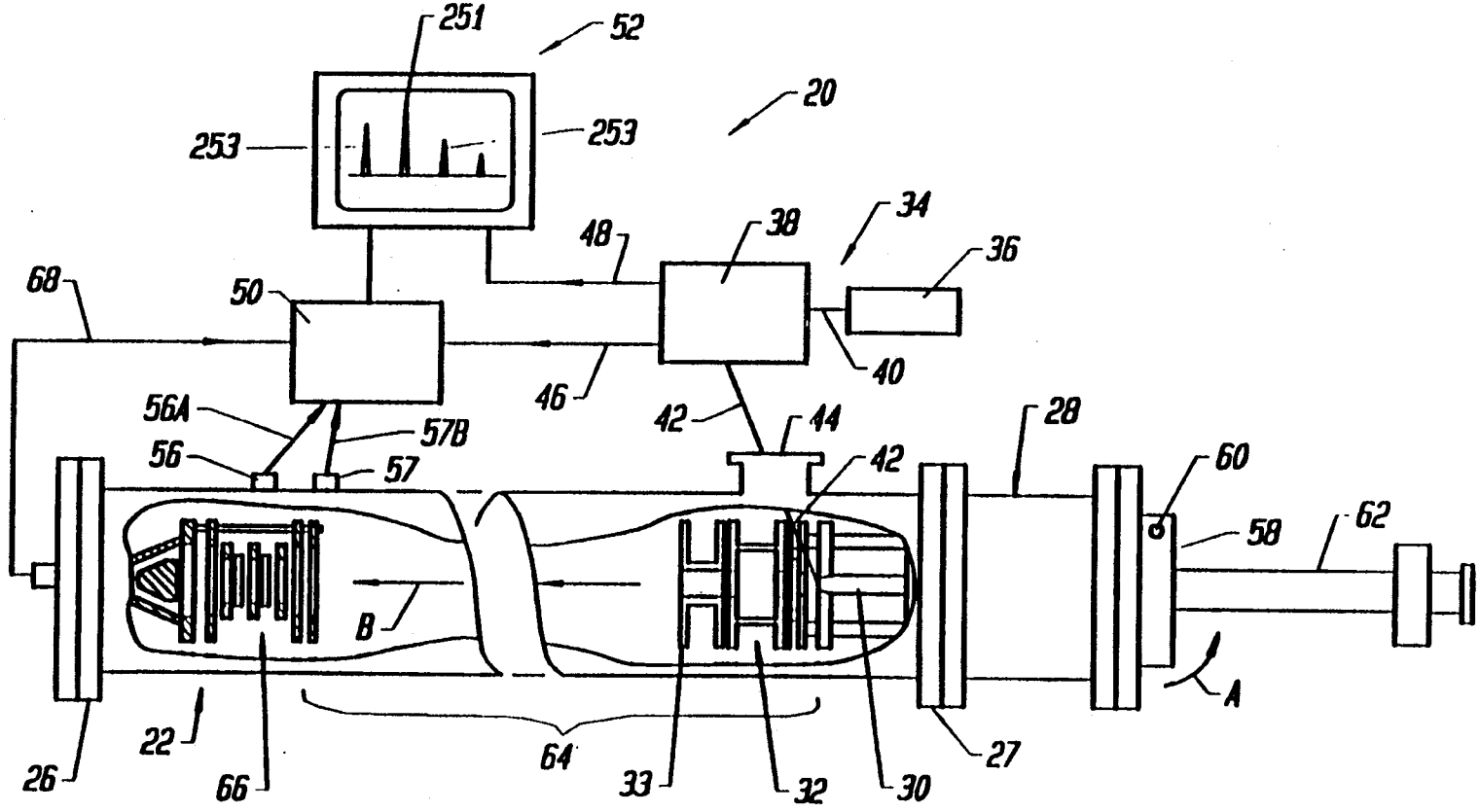
FIG. 1 schematically illustrates an LDIM instrument according to the present invention.

Referring now to the drawings in which like components are designated by like reference numerals, FIG. 1 shows a preferred embodiment of an LDIM instrument designated by the general numeral 20. Instrument 20 includes a generally cylindrical first vacuum chamber 22, having an end wall 24 and an end flange 26. Chamber 22 may be referred to as a time of flight tube, a flight tube, or a drift tube. Chamber 22 is provided with means (not shown) such as a mechanical roughing pump and a high vacuum pump as a turbomolecular pump for establishing a pressure of $10^{-6}$ torr therein. Mounted on end wall 24, is a second vacuum chamber 28, which may be termed a sample chamber. Sample chamber 28 is provided with means such as a mechanical vacuum pump for creating a rough vacuum therein. Sample chamber 28 may be isolated from or placed in vacuum communication with chamber 22. Located in sample chamber 28 is a means for storing a plurality of samples for analysis. Further details of sample lock 58 and the sample storage means will be given below. Samples to be analyzed, in the form of crystallized layers of an analyte/matrix mixture are introduced through ball valves lock 172 (see FIG. 6) into sample chamber 28 on a probe tip and into ion optics 32. Ion optics 32 include a deflector 33 for deflecting low mass ions.

Laser radiation for irradiation of samples is provided by laser optics 34 which includes a pulsed laser 36 and a laser beam train 38 including various components (not shown in FIG. 1) for focussing and directing a beam (pulse) 40 from the laser. Laser beam train 38 directs an output laser beam 42, which may be termed an irradiating pulse, into chamber 22 and onto probe tip 30 through a laser port 44. Laser beam train 38 also provides a signal 46 indicating the initiation of the irradiating pulse from laser beam train 38. Signal 46 is delivered to a microprocessor 50. Laser beam train 38 also provides a signal 48, indicating the intensity of the irradiating pulse, to a computing device 52 such as a personal computer. Signals 46 and 48 may be provided, for example by photodiodes.

Vacuum tube 22 may be provided with a rough vacuum gauge 56, such a pirani gauge, and a high vacuum gauge 57, preferably a cold cathode discharge gauge. Gauges 56 and 57 provide signals 56*a* and 56*b* respectively to microprocessor 50. Signals 56*a* and 56*b* may be used for example to control the evacuation of vacuum chamber 22 and to determine a safe point for energizing ion optics 32.

Figure 2:
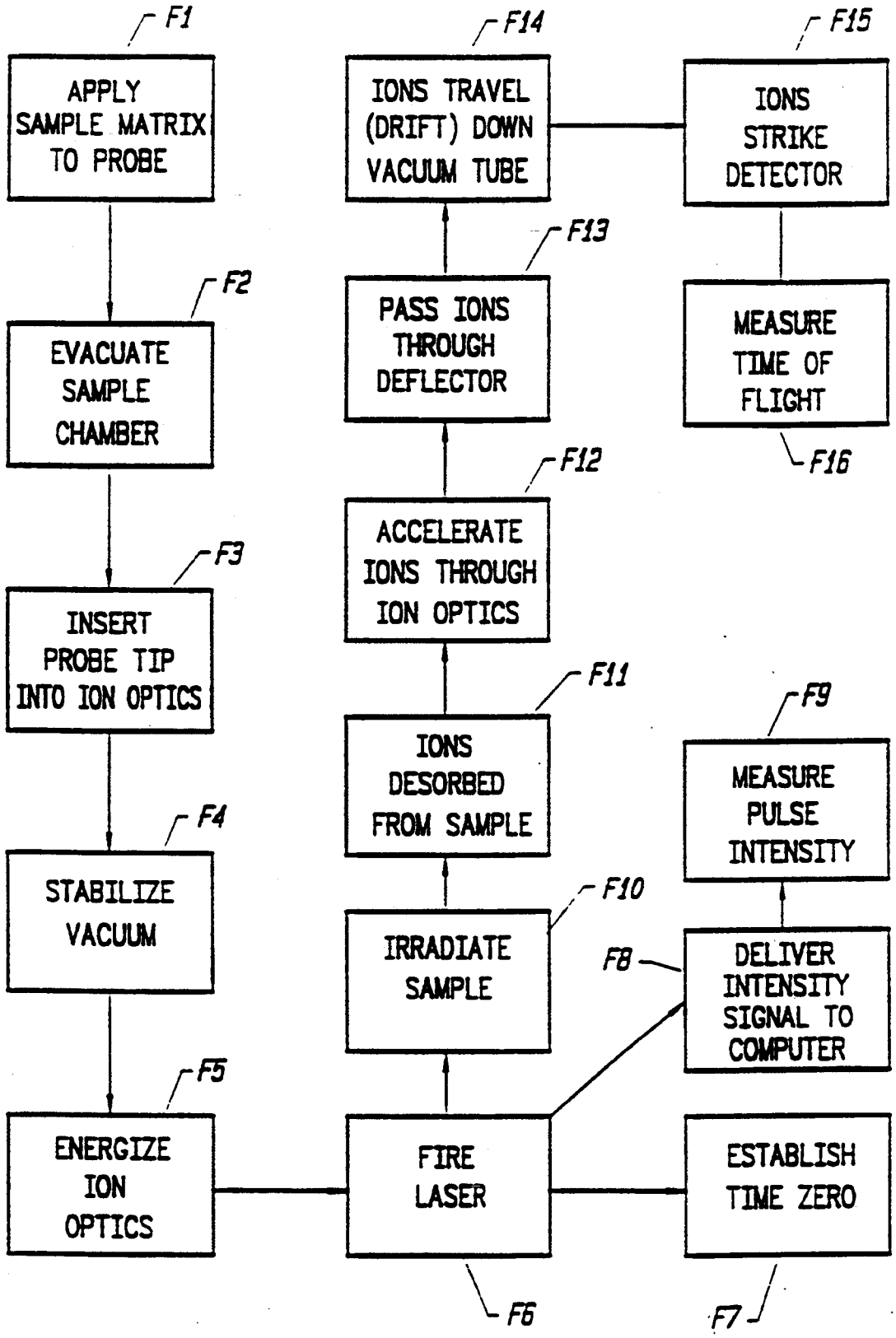
FIG. 2 is a flow chart depicting the sequence of operations of the instrument of FIG. 1.

Other components depicted in FIG. 1 will now be described in conjunction with a description of an exemplary operation sequence of instrument 20. The description may be followed in flow chart form by reference to FIG. 2 wherein various steps are depicted in blocks F1–F16.

A crystallized layer of sample/matrix mixture is applied to probe tip 30 (Block F1) and the sample placed through a vacuum valve or lock 58 (which may be termed the sample lock) into sample chamber 28. Sample lock 58 may be opened and closed by pivoting it about pivot 60 in the direction indicated by arrow A. Sample chamber 28 is evacuated (Block F2). Probe tip 30 is introduced (Block F3) into ion optics 32 by manipulating a shaft (not shown in FIG. 1) located within a tube 62 in vacuum communication with sample chamber 28. Vacuum in chamber 22 is allowed to stabilize (Block F4). Ion optics 32 are then energized (Block F5). The laser is fired to deliver an irradiating pulse (Block F6). Firing the laser triggers a photodiode in laser beam train 38 to deliver signal 46 to microprocessor 50, establishing time zero (Block F7). Another photodiode delivers signal 48 to computing device 52 (Block F8) where it is integrated and processed to provide information on the intensity of irradiating pulse 42 (Block F9).

Irradiation pulse 42 strikes the sample matrix layer on probe tip 30 and photo desorption and ionization takes place (Block F10). Ions produced in the desorption (Block F11) are accelerated through ion optics 32 (Block F12). The accelerated ions pass through deflector 33 to remove unwanted ionization products such as low mass matrix ions (Block F13). Ions exiting deflector 33 then drift freely down vacuum chamber 22 in the direction of arrow B (Block F14). The ions travel a distance 64, preferably about 1.75 meters (1.75 m), and strike a microchannel plate (MCP) detector assembly 66 (Block F15). MCP detector assembly 66 delivers a signal 68 to microprocessor 50. Signal 68 is used to establish the time of flight of the ions from the initiation of ionization by the irradiating pulse to their striking detector assembly 66 (Block F16).

The brief description of the function and principle components of instrument 20 given above is provided to assisting in understanding certain improvements and useful features of these key components which contribute to improved reproducibility and accuracy in LDIM measurements. These improvements and useful features are included in the detailed description of certain principle components of instrument 20 set forth below.

Figure 3:
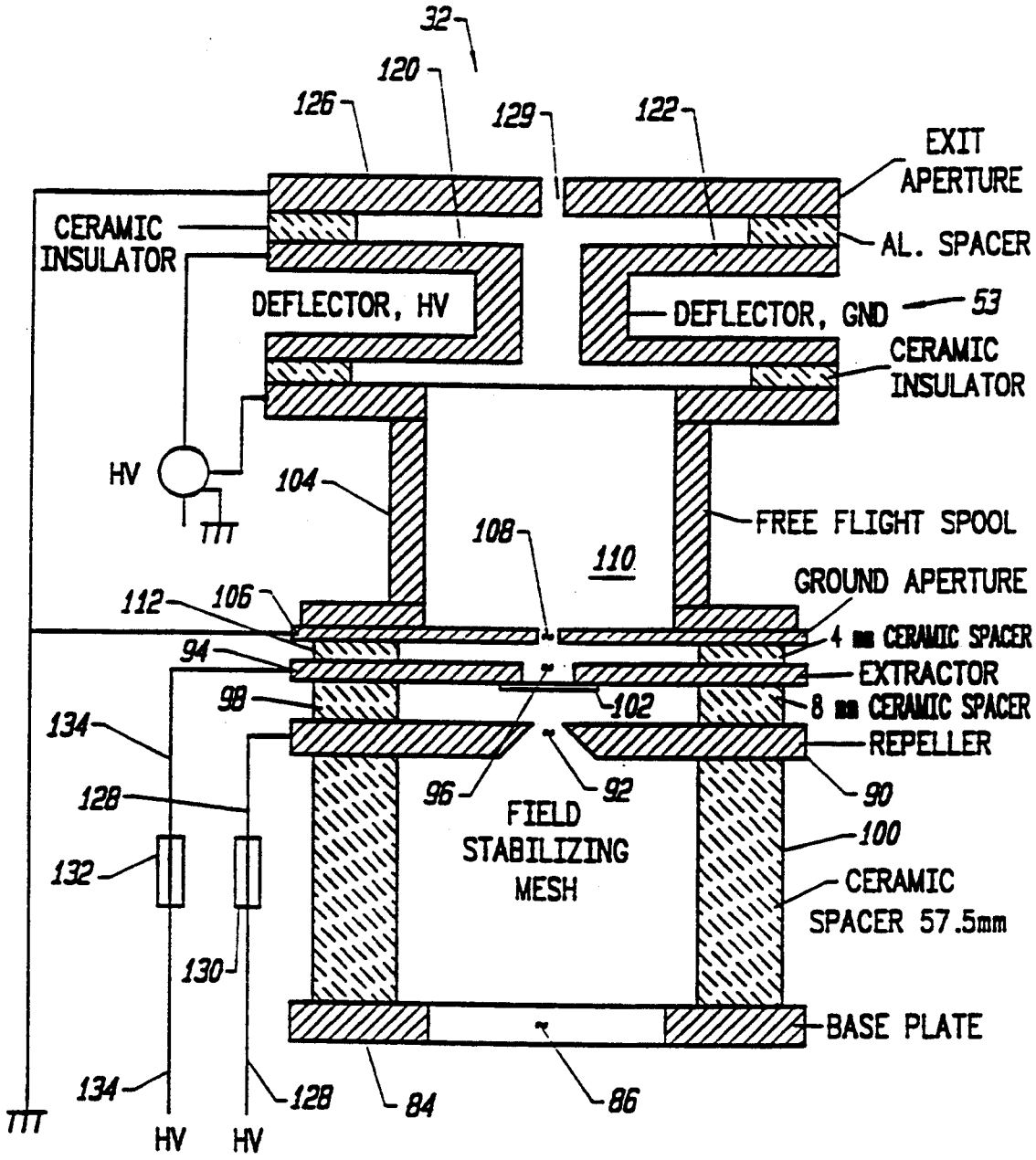
FIG. 3 is a cross section view schematically illustrating details of ion optics according to the present invention.

Referring now to FIG. 3, ion optics 32 includes a base plate 84 having an aperture 86 therein, a repeller electrode 90 having an aperture 92 therein, and an extractor electrode 94 having an aperture 96 therein. Repeller electrode 90 and extractor electrode 94 are separated or spaced by an insulating spacer 98. Repeller electrode 90 is separated by a ceramic spacer 100 from base plate 84. A sample to be irradiated is inserted into aperture 92.

The potential and spacing of repeller electrode 90 and extractor electrode 94 has been found important in achieving optimum mass resolution. Preferably, repeller electrode 90 and extractor electrode 94 are spaced by a distance of about eight millimeters (8 mm). Repeller electrode 90 is preferably held at a potential between about 28,000 volts and 32,000 volts and extractor electrode 94 is preferably held at a potential between about 9,000 volts and 15,000 volts. Potentials applied to repeller electrode 90 and extractor electrode 94 may be positive or negative depending on whether anions or cations are being desorbed from the sample. Applying these potentials has been referred to in the general description above as energizing ion optics 32. The potentials are preferably adjustable for fine tuning the performance of ion optics 32.

A field stabilizing mesh 102 may be located across aperture 96 for providing a more homogeneous electric field across aperture 96. The mesh 102 may be of copper, gold or aluminum wires having a spacing of between about fifty and one hundred lines per inch. The potentials on repeller electrode 90 and extractor electrode 94 may be provided by a high voltage power supply (not shown) via high voltage connections HV. The extractor electrode and repeller electrode current from the power supply may be monitored, for example by microprocessor 50, for magnitude and variation of the magnitude. If the magnitude or variation exceeds predetermined limits, this may be interpreted as indication of the onset of corona discharge and the like and ion optics may be de-energized to avoid potential damage thereto. A variation of about plus or minus three percent and a magnitude of about ten microamps have been found to be effective limits.

Figure 4:
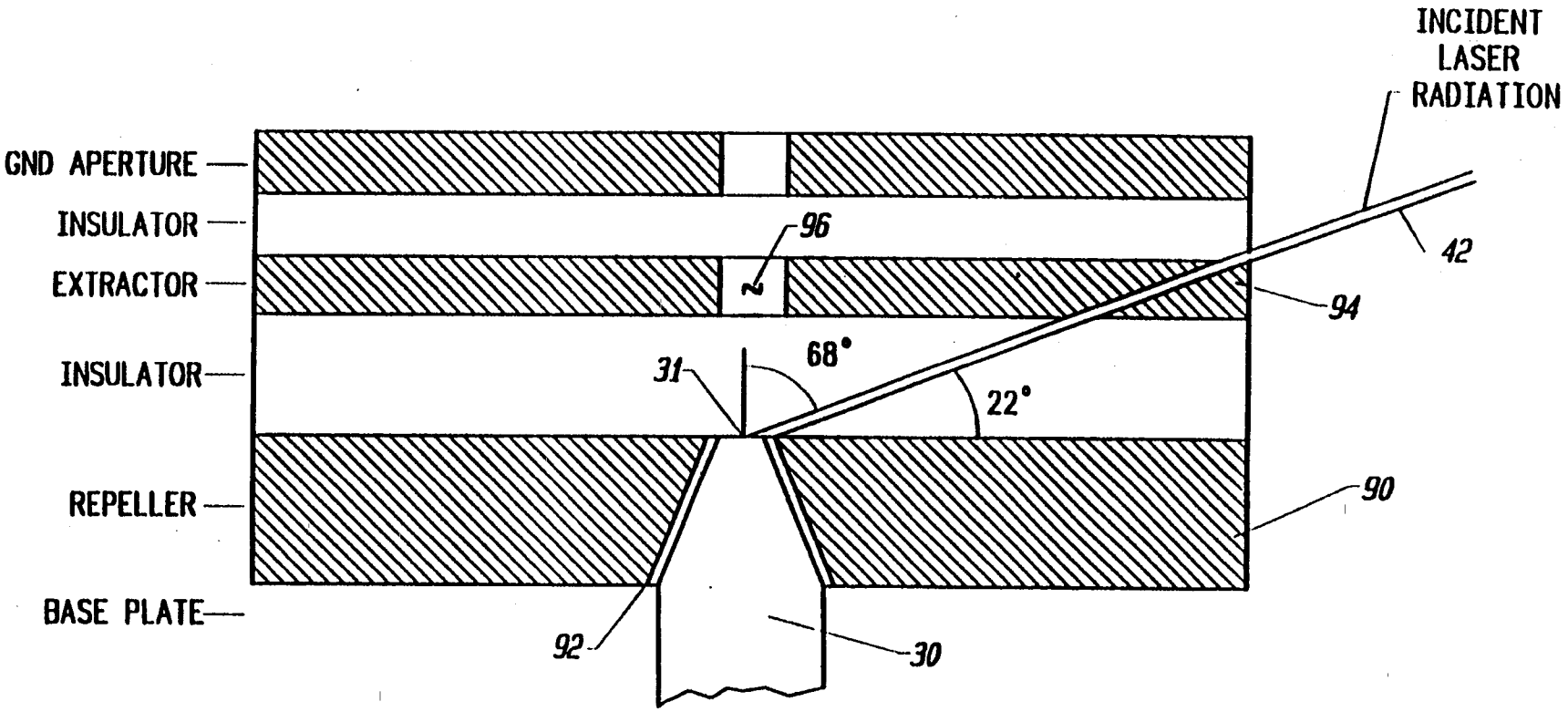
FIG. 4 schematically illustrates details of a repeller, extractor and sample arrangement in the ion optics of FIG. 3.

Turning now to FIGS. 3 and 4, details of a sample probe tip 30 inserted in ion optics 32 are now described. Tip 30 is inserted in aperture 92 in repeller electrode 90. Tip 30 includes a tip face 31 on which a crystallized sample layer of matrix and analyte is deposited. Irradiation pulse 42 is incident on tip face 31 (and thus on the sample layer) at an angle of between about fifteen and forty five degrees, preferably at about twenty two degrees, to face 31. Irradiating pulse 42 is also preferably incident off center of face 31 for reasons which will be further discussed below. As discussed above, laser pulse 42 desorbs analyte ions from the sample layer.

An electric field set up due to the potential difference between repeller electrode 90 and extractor electrode 94 accelerates desorbed ions through aperture 96 into free flight spool 104. Ions enter free flight spool 104 through an aperture 108 in a plate 106 which essentially forms an entrance aperture at end 110 of free flight spool 104. Plate 106 is preferably held at ground potential, as such plate 106 may be referred to as a ground aperture of the free flight spool. Plate 106 is separated from extractor electrode 94 by insulator 112. The separation of extractor electrode 94 and ground aperture 106 is another important factor in providing optimum mass resolution in instrument 20. Preferably, extractor electrode 94 and ground aperture 106 are separated by about 4 mm.

Ions drift through free flight spool 104 generally along a flight path corresponding to the axis of the free flight spool. The ions then pass through a deflector 33. In deflector 33 an electric field, the deflecting field, of between about plus or minus five hundred volts (500 volts) and fifteen hundred volts is applied across electrodes 120 and 122, i.e., perpendicular to the flight path of the ions. The deflecting field is applied, by high voltage high frequency pulse circuitry, preferably in the form of a square-wave pulse. The width of the pulse may be selected to deflect ions of a certain mass range generally less than the anticipated mass of the analyte. The field may be applied for example to any ionized matrix molecules which may be liberated when the analyte is desorbed from the sample.

As matrix molecules are lighter than the analyte molecules, they will travel faster down free flight spool 104 and will thus arrive at deflector 33 before the analyte molecules. As such, the deflecting field may be applied to deflect the matrix ions and then turned off in time to allow analyte molecules to pass undeflected through the deflector and through an aperture 124 in an end plate 126. End plate 126 is held at ground potential. The combination of deflector 33 and end plate 106 forms in effect a mass filter.

Another important feature of the ion optics assembly is an arrangement for limiting current. Many types of high voltage power supply which may be used to supply the desired potential to various elements such as repeller electrode 90 and extractor electrode 94 are capable of generating between about one hundred and four hundred microamps. If a catastrophic event such as corona or arc should occur within ion optics 32, damage to optics components and even to electronic signal processing equipment may occur. Damage to ion optics components may cause electric field distortion which may in turn adversely affect measurement performance.

In normal operation of LDIM instrument 20, the current drawn by the instrument should result primarily from the flight of the desorbed ions. Generally this current will be on the order of picoamps or even nanoamps, i.e., between about one thousand and one million times less than the current a power supply may be capable of delivering. In order to limit current a resistor 130 may be connected, by high voltage lines 128, between repeller electrode 90 and a power supply (not physically shown in FIG. 3 but represented by the symbol HV) and a resistor 132 may be connected, by high voltage lines 134, between extractor electrode 94 and a power supply (HV). The resistors are preferably high stability, high voltage resistors and may have a resistance value between about fifty and two hundred megohms. For example, if repeller 90 were held at 30,000 volts and resistor 130 had a value of two hundred megohms, current passing through resistor 130 would be limited to one hundred fifty microamps. This may be about sixty percent less than the current capability of the power supply.

Figure 5:
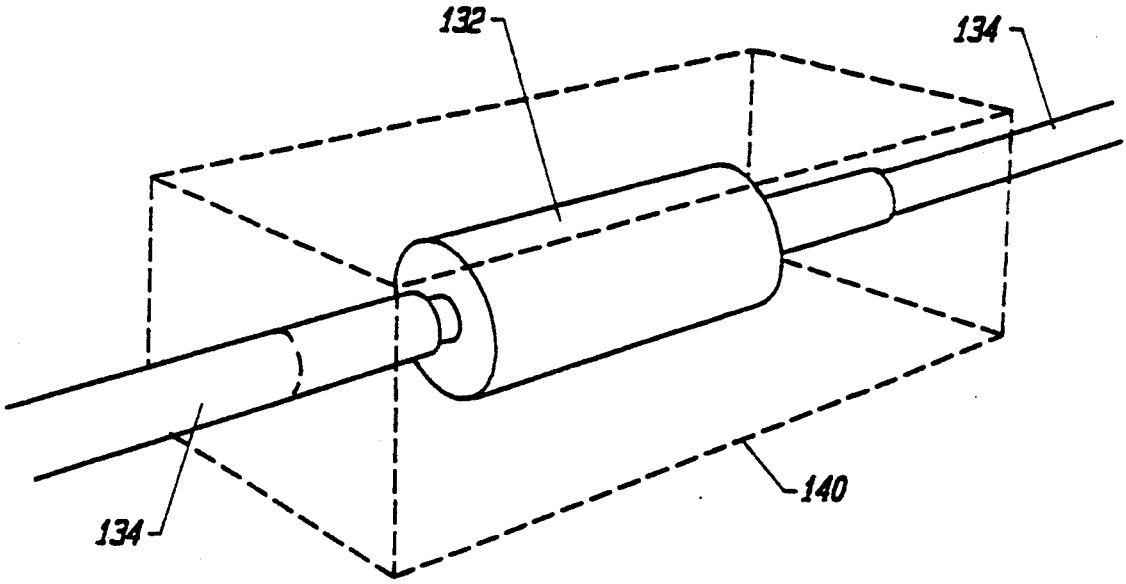
FIG. 5 schematically illustrates an embedded resistor for limiting current in ion optics according to the present invention.

A preferred method of connecting resistors 130 and 132 to high voltage lines 134 and 128 is to splice them such that they become, in effect, part of the high voltage lines. Resistors and attached high voltage lines are preferably insulated as a single unit by embedding them in an insulating material. Referring to FIG. 5, details of an embedded resistor, for example resistor 132, is shown. The resistor 132 attached to high voltage lines 134 is embedded in an insulating block 140 (outlined in phantom). The resistor and high voltage lines may be embedded by placing them in a mold (not shown) of suitable form and forming insulating block 140 around them, for example by casting it from an insulating epoxy resin material.

In the general description of instrument 20 (FIG. 1) given above, it is noted that sample chamber 28 includes means or arrangement for storing a plurality of samples for analysis under vacuum. Also included is a device for inserting the samples sequentially into ion optics 32. The device and its activating members may be referred to as an auto sampler. The auto sampler allows a number of samples to be analyzed without breaking vacuum in chamber 22. Vacuum conditions in chamber 22 may thus be maintained substantially constant over several measurements. This significantly reduces time of flight variations which may occur due to variations in the number of collisions with residual gas molecules which analyte molecules (ions) may experience during a flight period.

Figures 6, 6A:
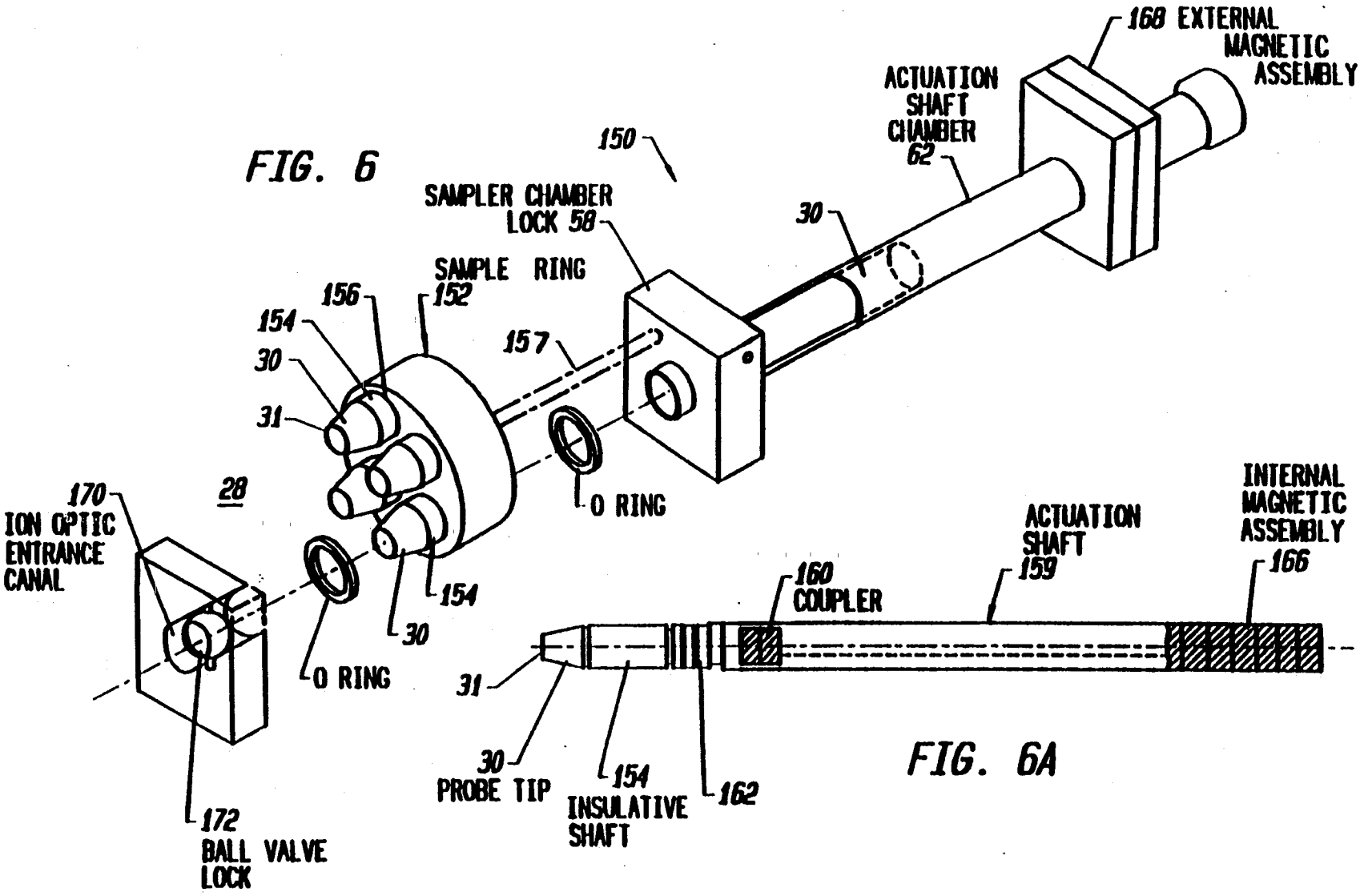
FIG. 6 schematically illustrates an autosampler arrangement according to the present invention FIG. 6*a* schematically illustrates details of an actuation shaft and a probe tip of the autosampler of FIG. 6.

Referring now to FIGS. 6 and 6*a* wherein an outline of sample chamber 28 has been omitted for clarity, components of auto sampler 150 include a sample ring 152 for holding a plurality of probe tips 30. Probe tips 30 are metal tips preferably plated with an inert metal such as gold or platinum. When inserted in aperture 92 of repeller electrode 90 (see FIG. 3), they may thus assume the potential of repeller electrode 90. Each tip 30 (See FIG. 6*a*) is mounted on an insulative shaft 154 of a material such as polycarbonate. Shaft 154 extends slidably through an aperture 156 in sample ring 152. Sample ring 152 is mounted on a spindle 157 which may be extended through a rotating vacuum seal (not shown) in sample chamber lock 58 to allow sample ring 152 to be rotated from without sample chamber 28.

Actuation shaft chamber 62, which is shown in FIG. 6 as withdrawn from sample chamber lock 58, is normally attached and sealed thereto, as shown in FIG. 1, such that it is in vacuum communication with sample chamber 28. Movably located in actuation shaft chamber 62 is an actuation shaft 159. Actuation shaft 159 includes at one end thereof, a coupler 160 which may engage a coupler 162 on insulative shaft 154. Couplers 160 and 162 may be either mechanical or magnetic. At the other end of actuation shaft 159 is a magnet assembly 166 which may be referred to as an internal (to chamber 62) magnet assembly.

Slidably mounted around actuator shaft chamber 62 is an external magnetic assembly 168 which may be placed in general alignment with internal magnet assembly 166 and used to rotate or translate actuation shaft 159 and thus a probe tip coupled thereto. Sample ring 152 is mounted such that a probe tip may be aligned with actuation shaft 159 and with an entrance canal 170 located in wall 24 of vacuum chamber 22. Probe tip 30 may thus be pushed through a ball valve lock 172 and through canal 170 into vacuum chamber 22 to engage repeller electrode 90 of ion optics 32. Following irradiation, probe tip 30 may be withdrawn with actuation shaft 159 back into sample ring 152. Sample ring 152 may then be rotated to align another probe tip 30 with actuation shaft 159. When no tip is inserted through canal 170, ball valve 172 isolates sample chamber 28 from vacuum chamber 22. As such when no tip is inserted through canal 170, sample chamber lock 58 may be opened to atmosphere to allow loading or unloading of samples without breaking vacuum in vacuum chamber 22.

Figure 7:
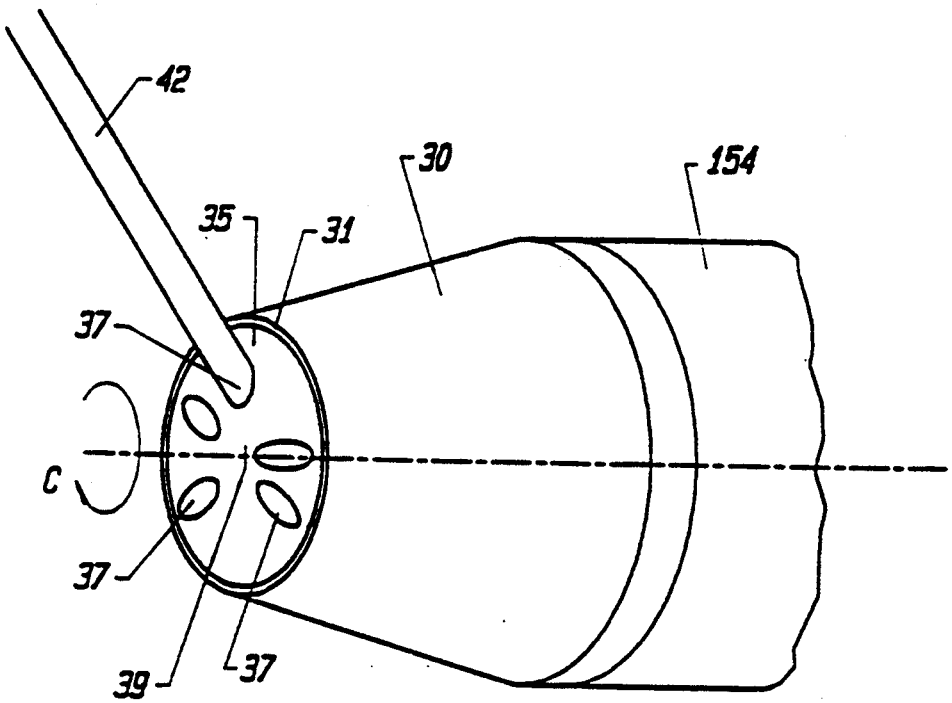
FIG. 7 schematically illustrates details of a method for providing multiple laser irradiation areas on a single probe tip.

Referring now to FIG. 7, additional means for providing multiple measurements without breaking vacuum are shown. Here, laser irradiation is incident on an area 37 located between the center and the edge of probe tip 31. Probe tip 30 may be rotated, as indicated by arrow C, such that different spaced-apart areas 37 of the sample layer, displaced from center 39, tip face 31 may be irradiated, sequentially, by an irradiating pulse 42. As such, multiple measurements may be made from one sample layer. Areas 37 preferably each have an area less than about 0.03 square millimeters.

Figure 8:
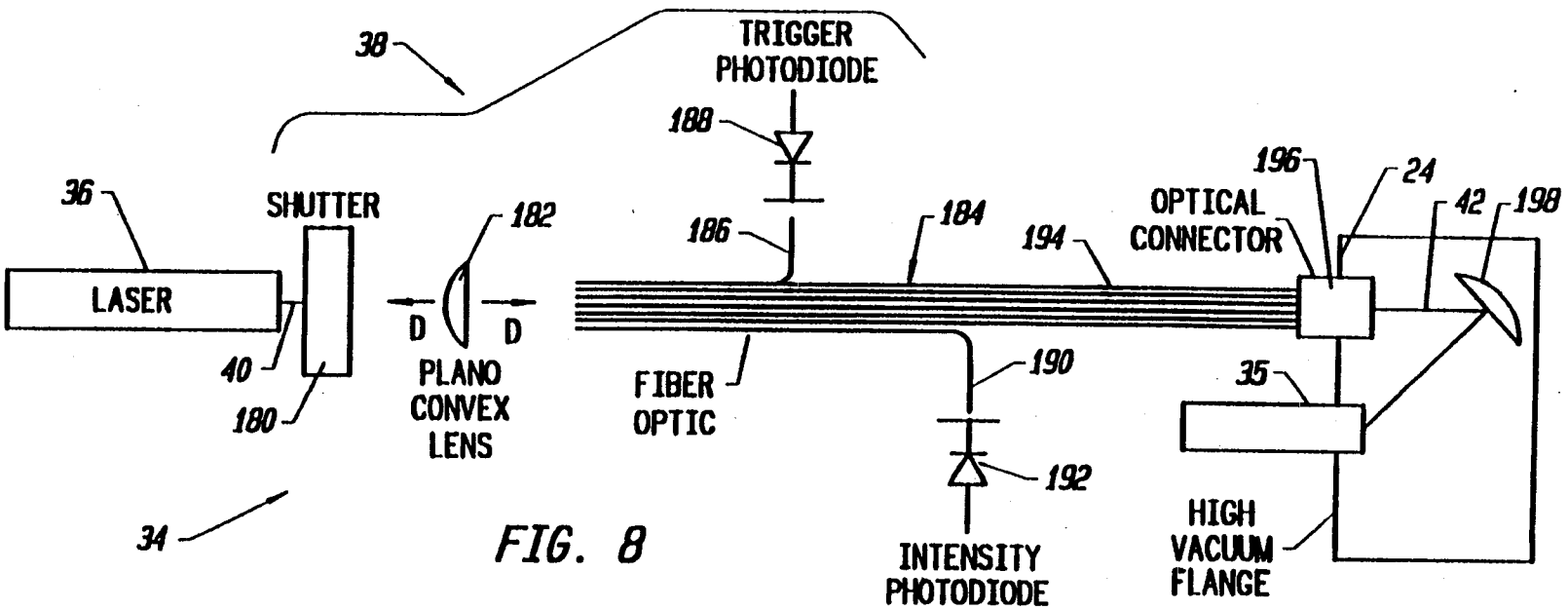
FIG. 8 schematically illustrates one embodiment of the laser optics for an LDIM instrument according to the present invention, including fiber optics for transmitting laser pulses.

Turning now to FIG. 8, one preferred embodiment of laser optics 34 is depicted. Laser optics 34 includes a laser 36 for providing light (radiation) to be directed through beam train 38 to a matrix material holding an analyte to be desorbed. Pulse (beam) 42 of laser radiation passes through a shutter 180 to a plano-convex or positive lens 182 which focusses the laser radiation on a fiber optic bundle 184, preferably of fused silica fibers for transmitting ultraviolet radiation. Positive lens 182 is adjustable in position in the direction indicated by arrows for adjusting the size of the focussed beam on fiber optic bundle 184. Any one of a number of types of pulsed laser may be used. Generally, laser 36 is selected such that it provides light radiation having a wavelength corresponding to an absorption band or bands of the matrix material. For example, a nitrogen laser providing a wavelength of 337 nanometers is preferred for a sinapinic acid matrix. A preferred laser pulse width is between about one and ten nanoseconds.

As discussed above, stability and repeatability of a laser pulse is important in optimizing mass resolution in an LDIM instrument. Generally, a laser will deliver its most stable output when it has been operating continuously for a period long enough for important operating parameters, for example, temperature, to equilibrate. An LDIM instrumented can be operated in a "single shot" measurement mode, i.e., the laser fires once, results are evaluated, and a decision is made, for example, as to whether or not to proceed with another measurement or the same location of the same probe or with different laser intensity. It has been found advantageous, however, to operate laser 36 in a repetitive pulse mode, i.e., the laser fires continuously at a given frequency even when a measurement is not being made. A nitrogen laser of 337 nanometers, for example, may be operated at a pulse rate between about two hertz (2 Hz) and ten hertz (10 Hz). Shutter 180 may be opened to admit a laser output pulse for irradiating the sample and closed immediately thereafter. As such laser 36 may be operated in its most stable mode while the LDIM is still used in a single-shot mode. This has been found advantageous in providing pulses having a high degree of repeatability.

In LDIM monitoring, it is most advantageous if a sample is irradiated with just sufficient power to exceed the threshold level of the analyte matrix combination. Irradiating at a higher power may lead to the formation of covalent abducts between the analyte and the matrix material. For example, in the case of a protein or a peptide analyte in a sinapinic acid matrix, adding excess power may cause sinapinic acid to combine with carboxyl groups of amino acid residues within the protein or peptide through a dehydrolysis reaction. The reaction may create molecules of the protein or peptide including one, two, three, or more sinapinic acid residues and cause TOF measurements to indicate a plurality and a distribution of molecular weights even though only one analyte is actually present in the matrix.

From the foregoing description, it will be evident that an ability to adjust the intensity of a laser pulse on a sample is useful in dealing with samples having different desorption threshold levels. Adjusting the position of positive lens 182 in the direction of arrows adjusts the size of a focussed laser pulse on fiber optic bundle 184 and may thus be used to adjust the intensity of a pulse transmitted thereby. As such, laser pulse intensity at a sample may be varied without disturbing operating parameters of laser 36.

Continuing with a description of laser optics 34, fiber bundle 184 is separated into three branches. A first branch 186 transmits a portion of a transmitted laser pulse to a first photodetector 188, preferably a high-speed photodiode, which generates a signal corresponding to the arrival of the pulse. The signal is passed to microprocessor 50 where it is used to indicate time zero, i.e., the beginning of the flight or drift time for analyte molecules desorbed from a sample. A second branch 190 transmits a portion of the laser pulse to a second photodetector 192 creating a signal representative of the laser pulse intensity. The signal is integrated in an integrator amplifier (not shown) and passed to computer device 52 where it may be used, for example, to normalize quantitative data. A third branch 194 transmits the remaining portion of the laser pulse to an optical connector 196 which may be located in wall 24 of vacuum chamber 22. From connector 196 pulse 42 is directed via a focusing mirror 188 onto a sample layer 35. Note here that details of ion optics components and the like have been omitted from the illustration to avoid obscuring optical details of the invention.

Figure 9:
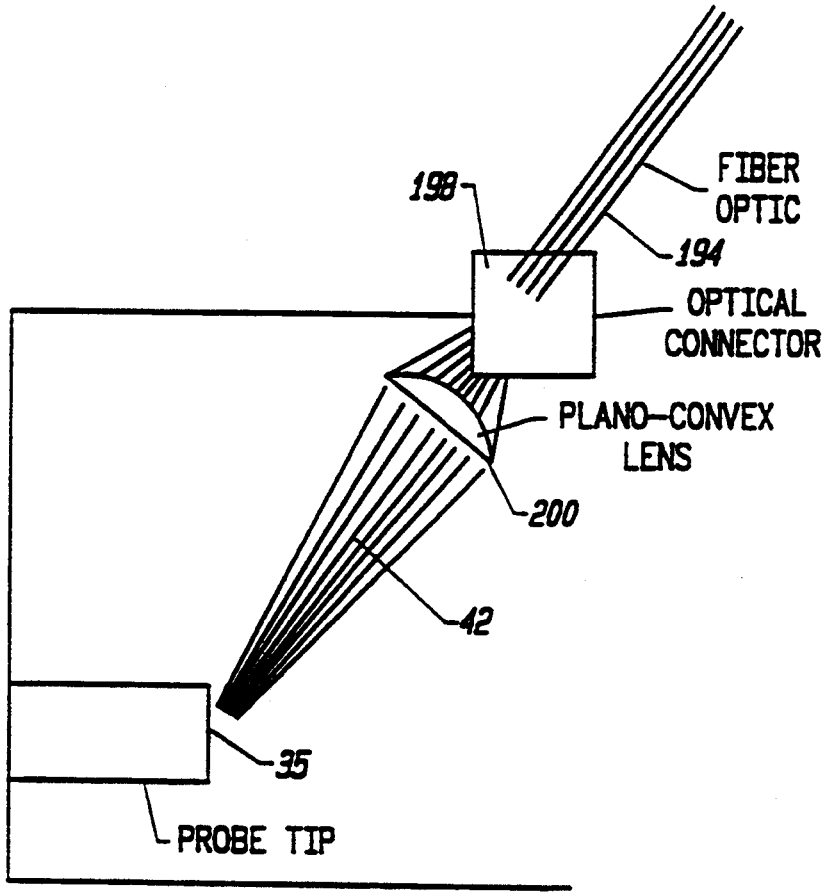
FIG. 9 schematically illustrates an alternate method of directing an irradiating pulse to a sample in the laser optics embodiment of FIG. 8.

In an alternate arrangement, illustrated in FIG. 9, optical connector 198 may be located in laser port 44. In this arrangement the laser pulse is directed through a positive focussing lens 200 which focusses the pulse directly onto sample 35 at the desired incidence angle.

Figure 10:
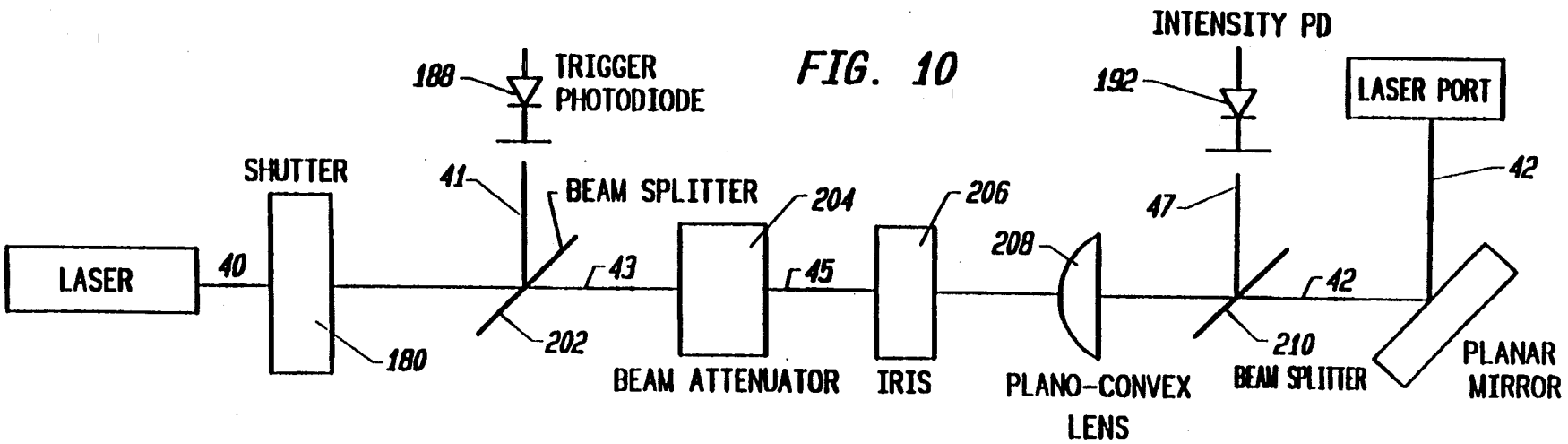
FIG. 10 schematically illustrates an embodiment of laser optics including beamsplitters and an attenuator.

Referring now to FIG. 10, in another embodiment of laser optics 34, a portion 41 of pulse 40 from laser 36 is reflected by a beamsplitter 202 to photodiode 188 for generating the timing pulse. The portion 43 of the pulse transmitted by beamsplitter 202 is passed through an attenuator 204. Attenuator 204 may comprise, for example, a plurality of thin glass plates (not shown) such as microscope slides. The plates attenuate the pulse due to fresnel reflection losses at their surfaces and by absorption of electromagnetic radiation. Should laser 36 age and lose output power, one or more plates may be removed from attenuator 204 to reduce attenuation. As such, the output pulse from attenuator 204 may be maintained at a substantially constant intensity. After passing through attenuator 204, the laser pulse passes through an iris diaphragm 206 and then through a positive focusing lens 208 which provides a means of focussing the pulse on sample 35. A second beamsplitter 210 reflects a portion 47 of the laser pulse transmitted through positive lens 208 to photodiode 192 for providing a pulse intensity dependent signal as described above. The portion 42 of the laser pulse transmitted through beamsplitter 210 is reflected by a plane mirror 212 through laser port 44 to sample as shown in FIG. 1.

Figure 11:
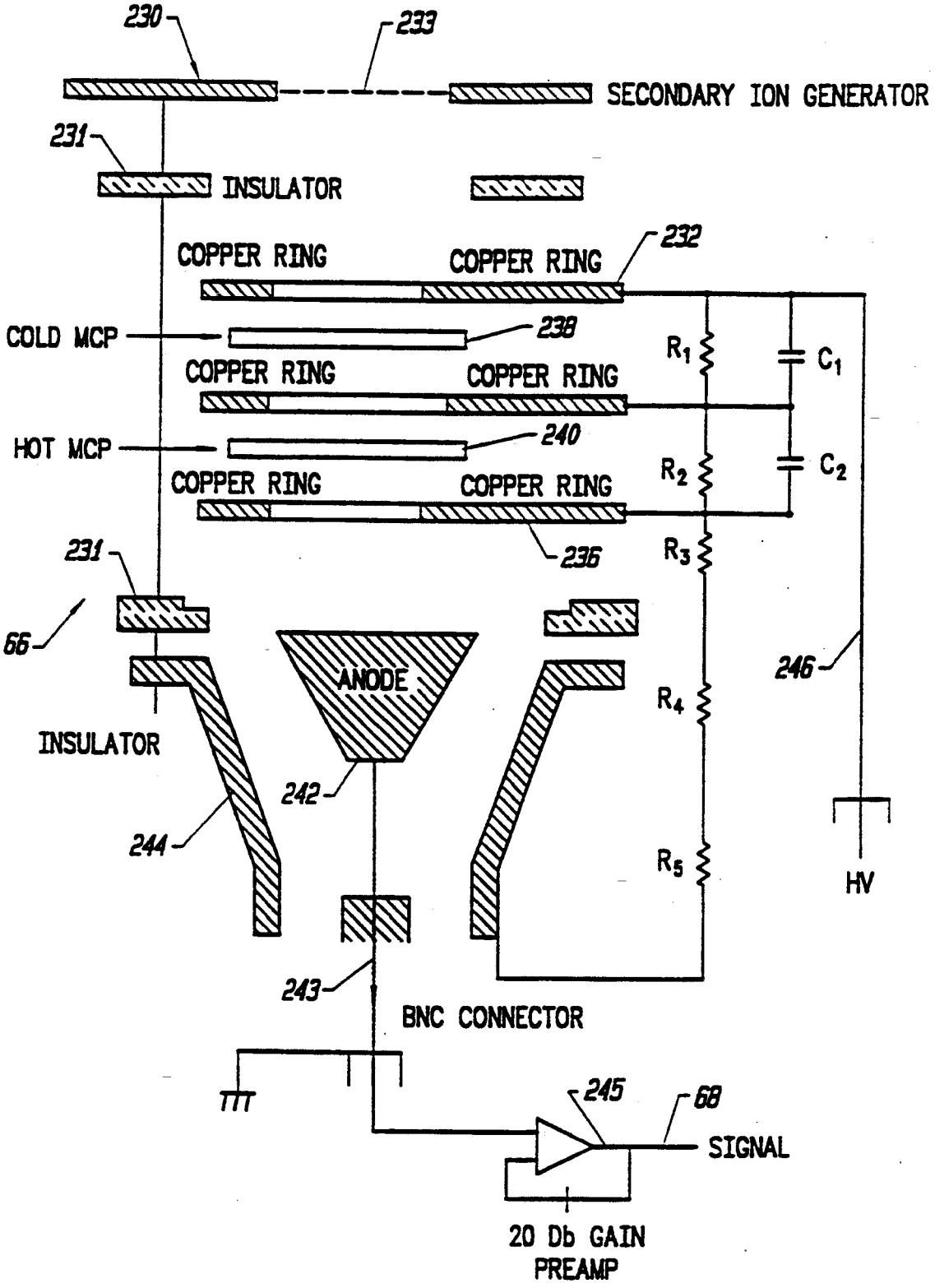
FIG. 11 is a cross-section view schematically illustrating one embodiment of a MCP detector assembly according to the present invention.

Turning now to FIG. 11, component and important features of micro-channel plate (MCP) detector assembly 66 are illustrated. Details of the mounting of the components are known to those familiar with the art and have been omitted to avoid obscuring the invention. Components of the detector include a secondary ion generator 230, an insulator 231, first, second, and third copper rings 232, 234, and 236, respectively, a first or cold microchannel plate 238, a second or hot microchannel plate 240, an anode 242, and a surrounding support 242, and a support member 244.

Charged molecules of the analyte drift from ion optics 32, down vacuum chamber 22, and arrive from at secondary ion generator 230. The arriving molecules have a large mass but generally only one unit charge. As such the large molecules do not generate an optimum signal in an MCP detector.

The secondary ion generator 230 provides that large molecules are fragmented into a number of small molecules each having a unit charge, essentially amplifying the signal. Secondary ion generator 230 includes a conductive screen 233 having an extremely fine mesh, for example about five hundred lines per inch. The mesh may be made, for example, from copper, silver, gold, or platinum. The mesh may be coated with a material such as nafion available from DuPont, of Wilmington, Del. Such a material when impacted by heavy charged molecules causes release of charged particles in addition to the ions created by the fragmentation of the heavy charged molecules. The screen 233 provides the fragmentation of the analyte molecules. The screen 233 is preferably held at ground potential. Ions produced by the fragmentation are primarily positive ions regardless of whether the charged analyte molecule or ion is an anion or a cation.

Ions generated by secondary ion generator 230 impinge on first microchannel plate 238. A microchannel plate comprises an assembly of microscopic tubes (not shown) which are arranged generally in the direction of travel of the ions but inclined at an angle of about five to twenty degrees thereto. An ion entering one of the tubes collides with the wall of the tube and releases electrons. The released electrons make further collisions with the tube wall as they travel down it releasing more electrons at each collision thus producing a cascade amplification process. After leaving first microchannel plate 238, electrons pass through second microchannel plate 240. Second microchannel plate 240 preferably has a lower gain than first microchannel plate 238, but has a higher dynamic range. This allows it to accept a larger number of electrons while still providing a gain of about one thousand. One ion entering first microchannel plate 238 may produce, for example, one-million electrons exiting second microchannel plate 240. The electrons leaving microchannel plate 240 travel to anode 242 producing a signal 243 which is passed through a 20 db preamplifier 245 to produce signal 68 which is delivered to microprocessor 50 for computing time of flight.

MCP detector assembly 66 is preferably operated at a high potential, for example, about plus or minus five thousand volts in order to impart a high velocity to ions produced by secondary ion generator 230 as they hit the microchannel plates. It is preferable, however, to limit the field across a microchannel plate to about one thousand volts. This is accomplished, for example, by placing a resistor R1 across rings 230 and 234, a resistor R2 across rings 234 and 236, and resistors R3, R4 and R5 in series between rings 236 and surround 244. If resistors R1, R2, R3, R4, and R5 have equal resistance, and a potential of five thousand volts is applied to ring 232 via a high voltage line 246, then the potential drop across each microchannel plate will be limited to about one thousand volts. Resistors R1, R2, R3, R4, and R5 preferably have a relatively high value, for example, between about 0.5 and 5.0 megohms, preferably about 2.0 megohms. A high resistance value limits current through the resistors and thus limits joule heating of the resistor. Joule heating would not be readily dissipated as the resistor operates in a vacuum.

A problem in MCP detectors is electron depletion. Electron depletion is the charge lost of a microchannel plate during an ion pulse amplification event. An analyte ion pulse may generate, for example, a current of about one hundred and twenty microamps. The event time period may be about 3.2 microseconds which could lead to a charge loss of about $4\times10^{-10}$ coulombs, which would be large for the amount of charge available in a microchannel plate thus causing electron depletion. To overcome electron depletion, a capacitor C1 is placed in parallel with resistor R1 and a capacitor C2 is placed in parallel with resistor R2. Capacitor C1 and C2 provide, in effect, a current reservoir. As such, when an ion pulse passes through microchannel plates 238 and 240, capacitors C1 and C2 discharge and add more electrons to replace the depletion caused by the passage of the ion pulse. The value of capacitors C1 and C2 is preferably selected such that the combination of C1 and R1 or C2 and R2 does not create a filter or RC network which will reduce signal strength of subsequent measurements or completion of discharge of the system. Preferably, C1 and C2 each have a value between about 0.1 and 5.0 nanoseconds. For example, a one nanofarad capacitor in parallel with a two megohm resistor provides a total duty cycle of about 2 msec if total discharge of the capacitor occurs. At a laser pulse repetition rate of 5 Hz, there would be a minimum of about 200 msec between analyte ion pulses, i.e. if every laser pulse was used for desorption. This provides an ample time interval for the capacitors C1 and C2 to recharge between pulses.

Another problem inherent in LDIM measurement is the formation of quasi molecular ions. During the desorption/ionization process ions are generated which may be termed univalent parent ions. These are the ions which have the greatest application in LDIM measurement, providing the easiest interpretation of results. A univalent parent ion is one molecule of the analyte plus or minus a proton, i.e., having unit charge (a charge of 1). It is also possible, however, that an ion may be formed from one molecule of the analyte plus or minus two three or more protons, i.e., having a charge of two three or more.

Further, it is possible that an ion may be formed from clusters of two or more parent molecules having one or more charges. In general then it is possible to produce ions having a mass m times the molecular weight of the analyte and n unit charges where m and n are integers of one or more. For a parent ion m and n are equal to one. Ions having values of m and n which are different are termed quasimolecular ions, and, as the velocity of ions through a TOF tube is directly proportional to their charge and inversely proportional to the square of their mass, each different quasi molecular ion will have a different time of flight through the TOF tube. These quasi molecular ions are artifacts of the LDIM method and are not actually present in the sample being measured. A method of identifying signals due to quasimolecular ions may be incorporated in signal processing software.

Figure 12:
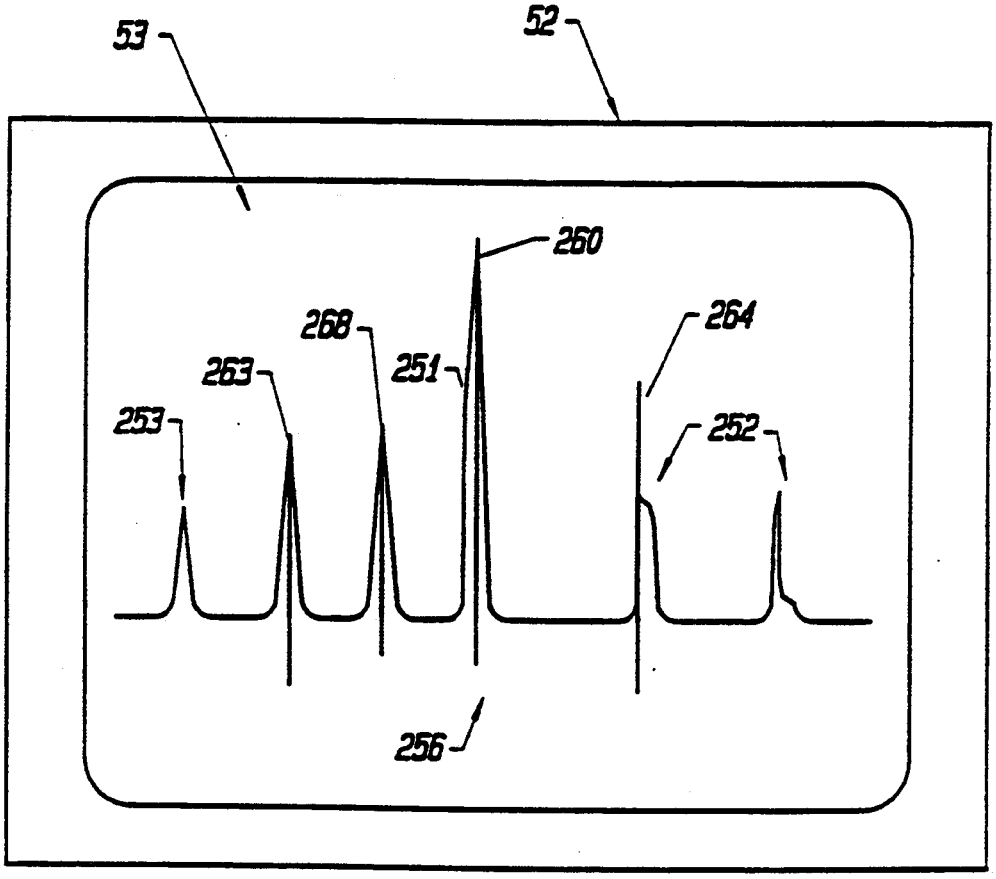
FIG. 12 schematically illustrates a sample display on a computer for evaluating measurement data produced by an LDIM instrument according to the present invention.

Referring now to FIG. 12 a method of identifying quasi molecular ions which may be controlled by a user of instrument 20 is set forth below. Signal processing software is arranged such that, after a desorption pulse has been fired, a display such as a CRT screen 53 of computer 52 displays a series of peaks 256 representing different times of flight, i.e. different mass charge ratios. This display is in effect a graph of peak intensity versus time or molecular weight. The peaks include a primary (highest) peak 251 and other lesser peaks 253. A user places a cursor 260 on the primary peak. Adjacent the primary peak, the time of flight in microseconds and the corresponding molecular weight in daltons is displayed. The software then computes the positions of quasi molecular species of a parent ion represented by the primary peak and displays cursors 263,264, and 268 at positions on the time axis corresponding to these quasi molecular species. For example, cursor 263 to the left of primary peak 251 may represent a quasi molecular ion having unit molecular weight two unit charges, while peak 264 to the right of primary peak 251 may represent a quasi molecular ion having twice unit molecular weights and one unit charge. Cursor 268 may represent a quasi molecular ion having three times unit molecular weight and four unit charges. A user may select the complexity of the cursor display depending on the sample being analyzed. When computed cursors representing quasi molecular ions align with displayed peaks as shown, the software can automatically eliminate these peaks as being unimportant data. The signal processing software can be implemented by one of ordinary skill in the art.

As discussed previously, another significant problem in LDIM measurements is sample preparation. It has been found that an ultrasonic spray method provides samples having superior thickness and chemical uniformity compared to prior art methods.

Figures 13, 14:
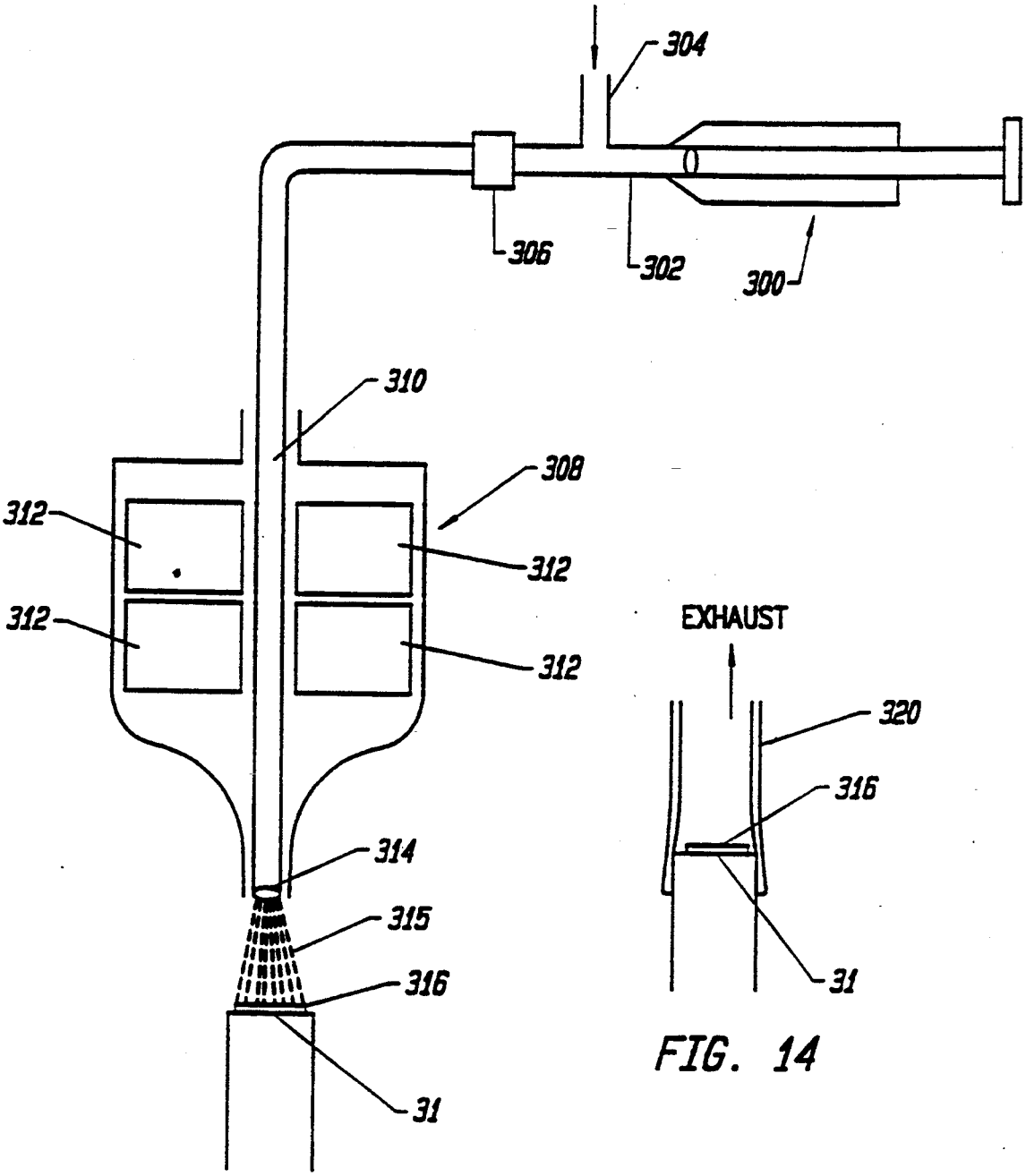
FIG. 13 schematically illustrates apparatus for applying a sample layer to a probe tip.
FIG. 14 schematically illustrates a method of vacuum crystallizing a layer produced in the apparatus of FIG. 13.

Referring now to FIG. 13, one embodiment of an ultrasonic sample spray method and apparatus is illustrated. A syringe pump 300 contains a solution of matrix material of a predetermined composition. Matrix material is pumped from syringe pump 300 into a conduit 302 which includes an inlet branch 304 through which sample material could be continuously flowed into the matrix material in the desired proportion. Matrix and sample then enter a vortex micromixer 306 where they are thoroughly mixed. The mixture then flows into an ultrasonic spray module 308. Ultrasonic spray module 308 includes a delivery tube 310 surrounded by one or more piezo electronic ultrasonic transducers 312. Energy from ultrasonic transducers 312 is concentrated into the matrix/sample mixture in delivery tube 310 and together with pressure applied by syringe pump 300 causes the mixture to exit a nozzle region 314 as an extremely fine mist 315. The mist is deposited as a layer 316 on probe tip face 31.

Probe tip face 31 is then enclosed in a sealed flexible chamber 320 (See FIG. 14) which is connected to a vacuum pump such as a rotary mechanical pump. When chamber 320 is exhausted volatiles evaporate from layer 316 and the layer crystallizes. It has been found that this ultrasonic deposition method will produce uniform homogeneous sample layers at least comparable or better than layers produced by electrospray methods without the hazards associated with high voltage operation.

The foregoing descriptions of specific embodiments of the present invention have been presented for purposes of illustration and description. They are not intended to be exhaustive or to limit the invention to the precise forms disclosed, and it should be understood that many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the claims appended hereto and their equivalents.

What is claimed is:

1. An apparatus for measuring the mass of desorbed and ionized organic molecules which are desorbed and ionized by laser irradiation of a homogeneous mixture of a host matrix and said organic molecules, said apparatus comprising:

a detector for detecting said desorbed ionized molecules;

ion optics for directing said desorbed ionized molecules to said detector;

said detector and said ion optics located in a first vacuum chamber having a vacuum therein; and a second vacuum chamber mounted on said first vacuum chamber, said second chamber including means for holding a plurality of probe tips each having a tip face covered with a layer of said mixture, and means for removably inserting a predetermined one of said probe tips into said ion optics without breaking said vacuum in said first vacuum chamber.

2. The apparatus of claim 1 further including laser optics which direct a laser pulse to irradiate a predetermined area of said layer for desorbing and ionizing said organic molecules.

3. The apparatus of claim 2 wherein said predetermined area is located between the center and the edge of said tip face.

4. The apparatus of claim 2 wherein said tip face has a plurality of spaced apart sample areas, said sample areas covered with said layer of said mixture.

5. The apparatus of claim 4 further including means for rotating said tip face such that said spaced apart sample areas thereon are sequentially irradiated.

6. The apparatus of claim 1 wherein said plurality of probe tips are sequentially introduced into said ion optics.

7. The apparatus of claim 6 wherein said ion optics include a repeller electrode.

8. The apparatus of claim 7 wherein each of said probe tips is recessed relative to said repeller electrode when introduced into said ion optics.

9. The apparatus of claim 7 wherein said ion optics further include a ground electrode and an extractor electrode, said extractor electrode mounted parallel to and between said ground electrode and said repeller electrode.

10. The apparatus of claim 9 wherein said repeller electrode, said extractor electrode, and said ground electrode are separated by insulators having a high dielectric constant.

11. The apparatus of claim 1 further including a high voltage supply cable coupling said ion optics to a high voltage power supply.

12. The apparatus of claim 11 wherein said high voltage supply cable includes a current limiting resistor.

13. The apparatus of claim 12 wherein said current limiting resistor and said high voltage cable are embedded in a contiguous jacket of insulative epoxy.

14. The apparatus of claim 1 wherein said ion optics produce acceleration fields which accelerate said ionized organic molecules.

15. The apparatus of claim 14 wherein said acceleration fields are monitored for stability and magnitude.

16. The apparatus of claim 15 further including means for discounting said mass measurements when the stability and magnitude of said accelerator fields are outside a predetermined range.

17. The apparatus of claim 1 wherein said detector includes an array of cold and hot microchannel plates.

18. The apparatus of claim 17 wherein said detector further includes a secondary ion generator means for fragmenting said desorbed ionized molecules and for spreading said fragments over a larger area.

19. The apparatus of claim 18 wherein said secondary ion generator means includes a wire mesh coated with a polymer.

20. The apparatus of claim 17 further including means for storing charge coupled to said microchannel plates.

21. The apparatus of claim 1 wherein said detector generates an electrical signal in response to detection of said desorbed ionized molecules, said electrical signal coupled to an amplifier.

* * * * *